US006644470B1

(12) United States Patent
Grayson

(10) Patent No.: US 6,644,470 B1
(45) Date of Patent: Nov. 11, 2003

(54) CIGARETTE PACKAGE WITH INCORPORATED MATCHES

(76) Inventor: Liberty Grayson, 510 N. Hampton St., Anaheim, CA (US) 92801

( * ) Notice: Subject to any disclaimer, the term of this patent is extended or adjusted under 35 U.S.C. 154(b) by 234 days.

(21) Appl. No.: 09/933,429

(22) Filed: Aug. 20, 2001

(51) Int. Cl.[7] ..... B65D 85/10
(52) U.S. Cl. ..... 206/92; 206/90
(58) Field of Search ..... D27/174, 175; 206/90–95

(56) References Cited

U.S. PATENT DOCUMENTS

| | | | | | |
|---|---|---|---|---|---|
| 2,273,611 | A | * | 2/1942 | Anderson et al. | 206/94 |
| 2,891,712 | A | * | 6/1959 | De Ford et al. | 206/93 |
| 2,975,890 | A | * | 3/1961 | Block | 206/92 |
| 3,065,849 | A | * | 11/1962 | Rice et al. | 206/92 |
| D243,350 | S | * | 2/1977 | Shibata et al. | D27/175 |

* cited by examiner

*Primary Examiner*—Jim Foster
(74) *Attorney, Agent, or Firm*—Goldstein & Lavas, P.C.

(57) ABSTRACT

A cigarette package with incorporated matches including a container dimensioned for containing a quantity of cigarettes therein. The container has an open upper end, a closed lower end, a front wall, a rear wall, and opposed side walls. The front wall has a lower front foldable cover with a flap. The rear wall has a cover member foldably secured thereto for selectively covering the open upper end. One of the opposed side walls has a match striking surface disposed thereon upwardly of the closed lower end. A match protector is layered between the front inside wall of the container and the matches providing space for the lightable match tips and for container rear wall cover member to uniformly close upon. An upper set of matches are removably coupled with the front wall of the protective insert downwardly of the open upper end. Each of the upper set of matches has a lightable tip. A lower set of matches are removably coupled with the front wall of the container downwardly of the upper set of matches. Each of the lower set of matches has a lightable tip.

7 Claims, 8 Drawing Sheets

28
24
22
24

16

16
20
24
12
18
54
56

CIGARETTE PACKAGE WITH INCORPORATED MATCHES

BACKGROUND OF THE INVENTION

The present invention relates to a cigarette package with incorporated matches and more particularly pertains to including a supply matches for ready use with cigarettes.

The use of combination cigarette package devices is known in the prior art. More specifically, combination cigarette package devices heretofore devised and utilized for the purpose of attaching matches to cigarette packages are known to consist basically of familiar, expected and obvious structural configurations, notwithstanding the myriad of designs encompassed by the crowded prior art which have been developed for the fulfillment of countless objectives and requirements.

By way of example, U.S. Pat. No. 1,504,357 to Lebwohl discloses a cigarette box with a hinged flap for covering an incorporated supply of matches. U.S. Pat. No. 4,836,366 to Maikail discloses a cigarette pack with an attached book of matches. U.S. Pat. No. 3,302,178 to Graifman and U.S. Pat. No. 3,713,531 to Doumas disclose cigarette packages with incorporated means for holding matches.

While these devices fulfill their respective, particular objective and requirements, the aforementioned patents do not describe a cigarette package with incorporated matches for including a supply matches for ready use with cigarettes.

In this respect, the cigarette package with incorporated matches according to the present invention substantially departs from the conventional concepts and designs of the prior art, and in doing so provides an apparatus primarily developed for the purpose of including a supply matches for ready use with cigarettes.

Therefore, it can be appreciated that there exists a continuing need for a new and improved cigarette package with incorporated matches which can be used for including a supply matches for ready use with cigarettes. In this regard, the present invention substantially fulfills this need.

SUMMARY OF THE INVENTION

In the view of the foregoing disadvantages inherent in the known types of combination cigarette package devices now present in the prior art, the present invention provides an improved cigarette package with incorporated matches. As such, the general purpose. of the present invention, which will be described subsequently in greater detail, is to provide a new and improved cigarette package with incorporated matches which has all the advantages of the prior art and none of the disadvantages.

To attain this, the present invention essentially comprises a container having a generally rectangular configuration. The container is dimensioned for containing a quantity of cigarettes therein. The container has an open upper end, a closed lower end, a front wall, a rear wall, and opposed side walls. The front wall has a lower foldable cover with a flap in communication with the lower closed end. The rear wall has a cover member foldably secured thereto for selectively covering the open upper end and the arcuate cutout. One of the opposed side walls has a match striking surface disposed thereon upwardly of the closed lower end. A protective insert is disposed within the container. The protective insert has an open upper end, a closed lower end, a high front wall, and opposed side walls. The front wall has an arcuate recess extending downwardly thereof. An upper set of matches are removably coupled with the front wall of the container downwardly of the open upper end. Each of the upper set, of matches has a lightable tip. The upper set of matches have a match spacer disposed thereon exposing the lightable tips. The lightable tips are covered by the cover member of the container in a closed orientation. A lower set of matches are removably coupled with the front wall of the container downwardly of the upper set of matches. Each of the lower set of matches has a lightable tip. The lower set of matches have a foldable cover disposed thereon. The foldable cover has a flap positionable between the front wall and the closed lower end of the container in a closed orientation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cigarette package with incorporated matches which has all the advantages of the prior art combination cigarette package devices and none of the disadvantages.

It is another object of the present invention to provide a new and improved cigarette package with incorporated matches which may be easily and efficiently manufactured and marketed.

It is a further object of the present invention to provide a new and improved cigarette package with incorporated matches which is of durable and reliable construction.

An even further object of the present invention is to provide a new and improved cigarette package with incorporated matches which is susceptible of a low cost of manufacture with regard to both materials and labor, and which accordingly is then susceptible of low prices of sale to the consuming public, thereby making such a cigarette package with incorporated matches economically available to the buying public.

Even still another object of the present invention is to provide a new and improved cigarette package with incorporated matches for including a supply matches for ready use with cigarettes.

Lastly, it is an object of the present invention to provide a new and improved cigarette package with incorporated matches including a container dimensioned for containing a quantity of cigarettes therein. The container has an open upper end, a closed lower end, a front wall, a rear wall, and opposed side walls. The front wall has a lower foldable cover with the flap. The rear wall has a cover member foldably secured thereto for selectively covering the open upper end. One of the opposed side walls has a match striking surface disposed thereon upwardly of the closed lower end. An upper set of matches are removably coupled with the protective insert and match spacer affixed inside the front wall of the container downwardly of the open upper end. Each of the upper set of matches has a lightable tip. A lower set of matches are removably coupled with the front wall of the container downwardly of the upper set of matches. Each of the lower set of matches has a lightable tip.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
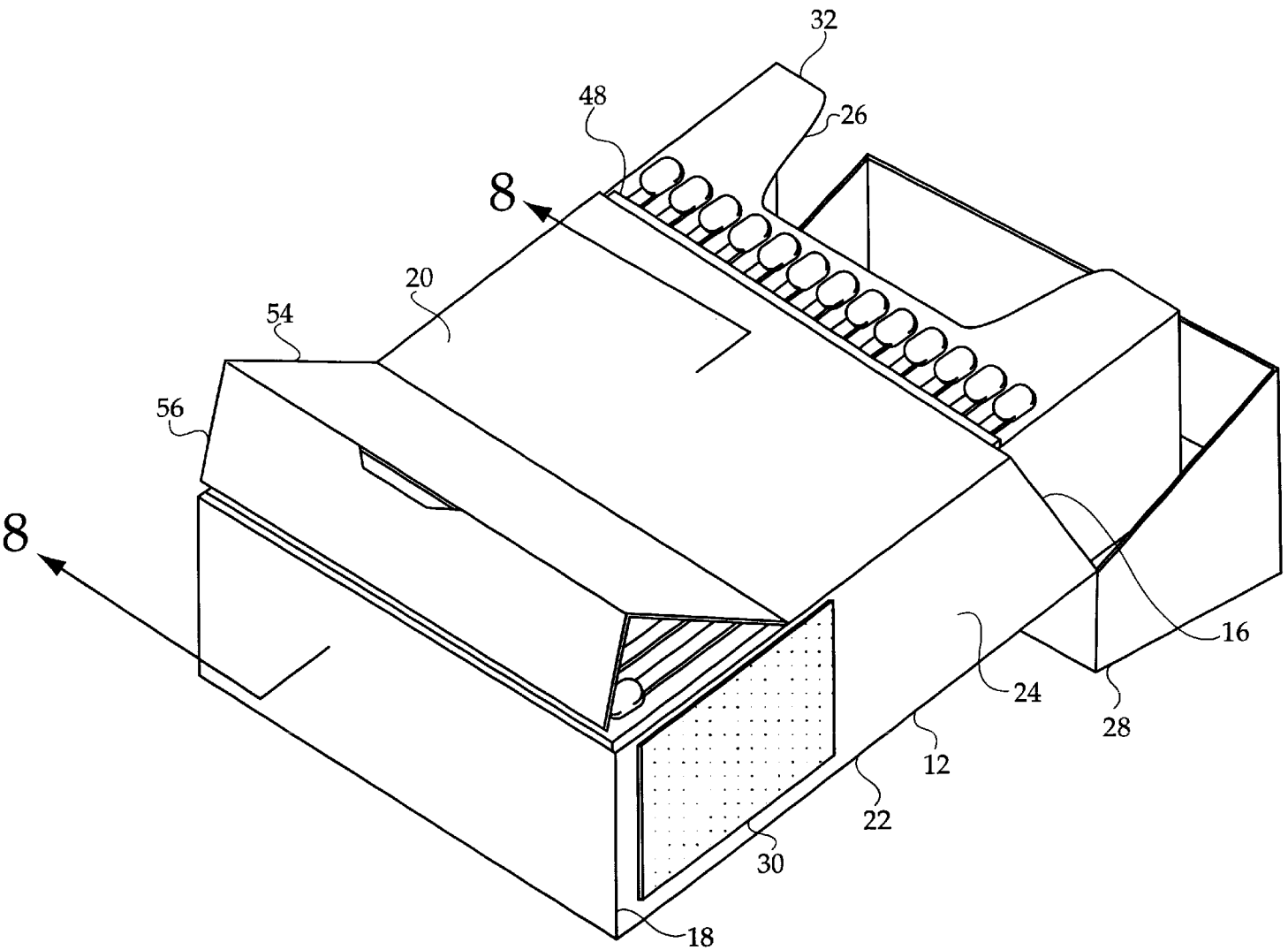
FIG. 1 is a perspective view of the preferred embodiment of the cigarette package with incorporated matches constructed in accordance with the principles of the present invention.
Figure 3:
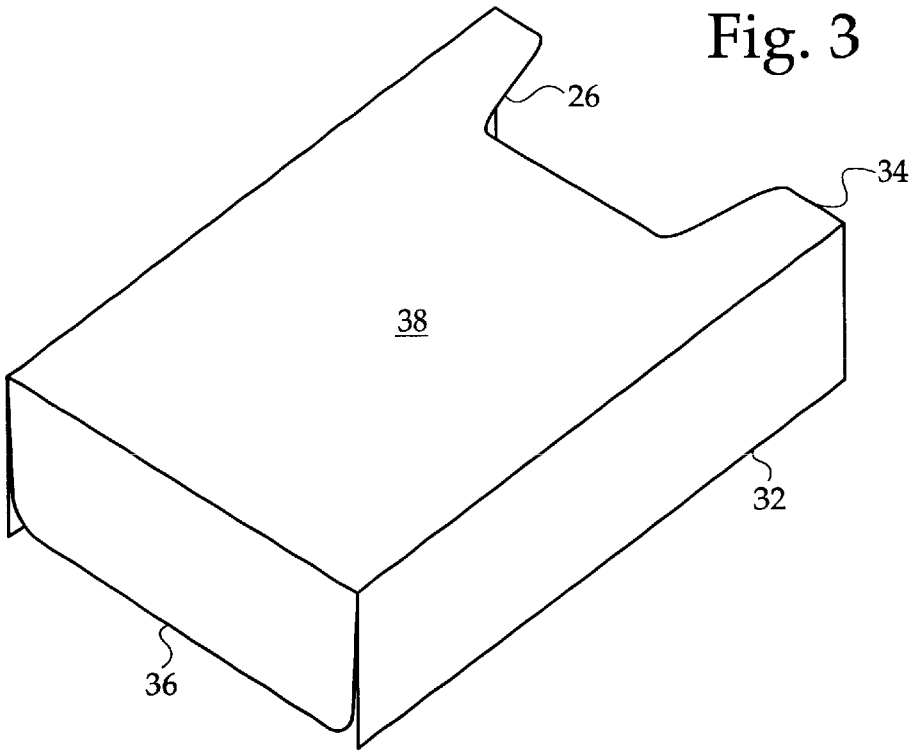
FIG. 3 is a perspective view of the protective insert of the present invention before insertion into the cigarette container.
Figure 2:
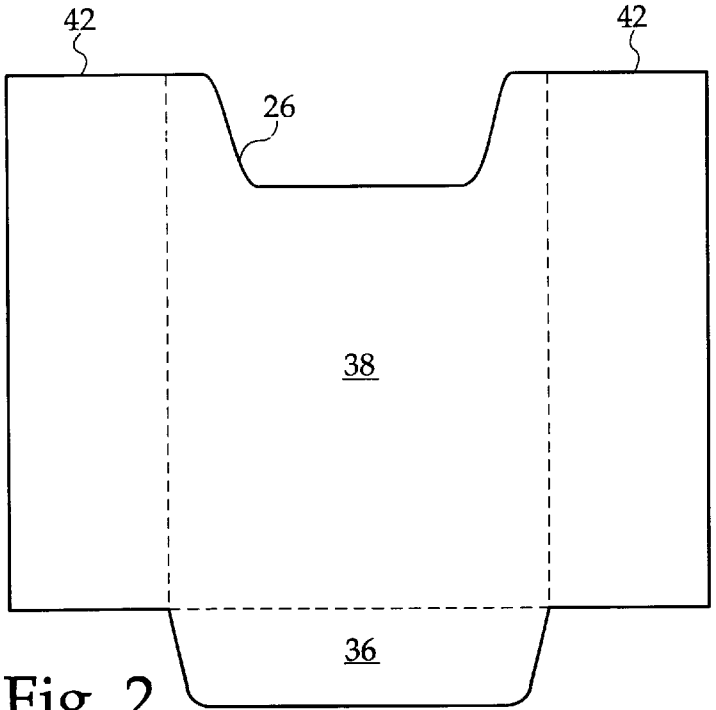
FIG. 2 is a plan view of just the protective insert of the present invention, unfolded and laid flat.
Figure 4:
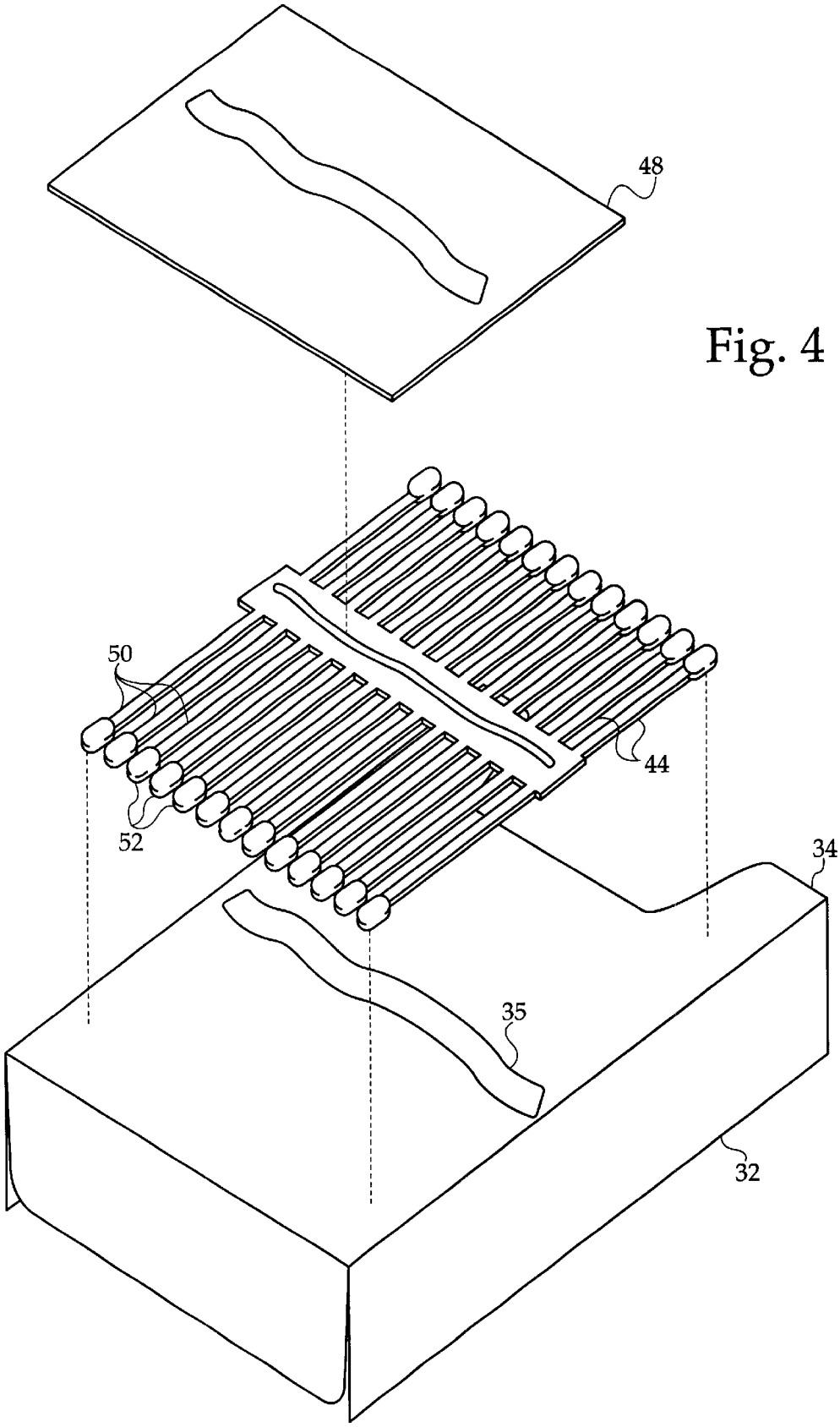
FIG. 4 is an exploded view, illustrating attachment of the matches to the protective insert, and covering thereof with the match protector.
Figure 5:
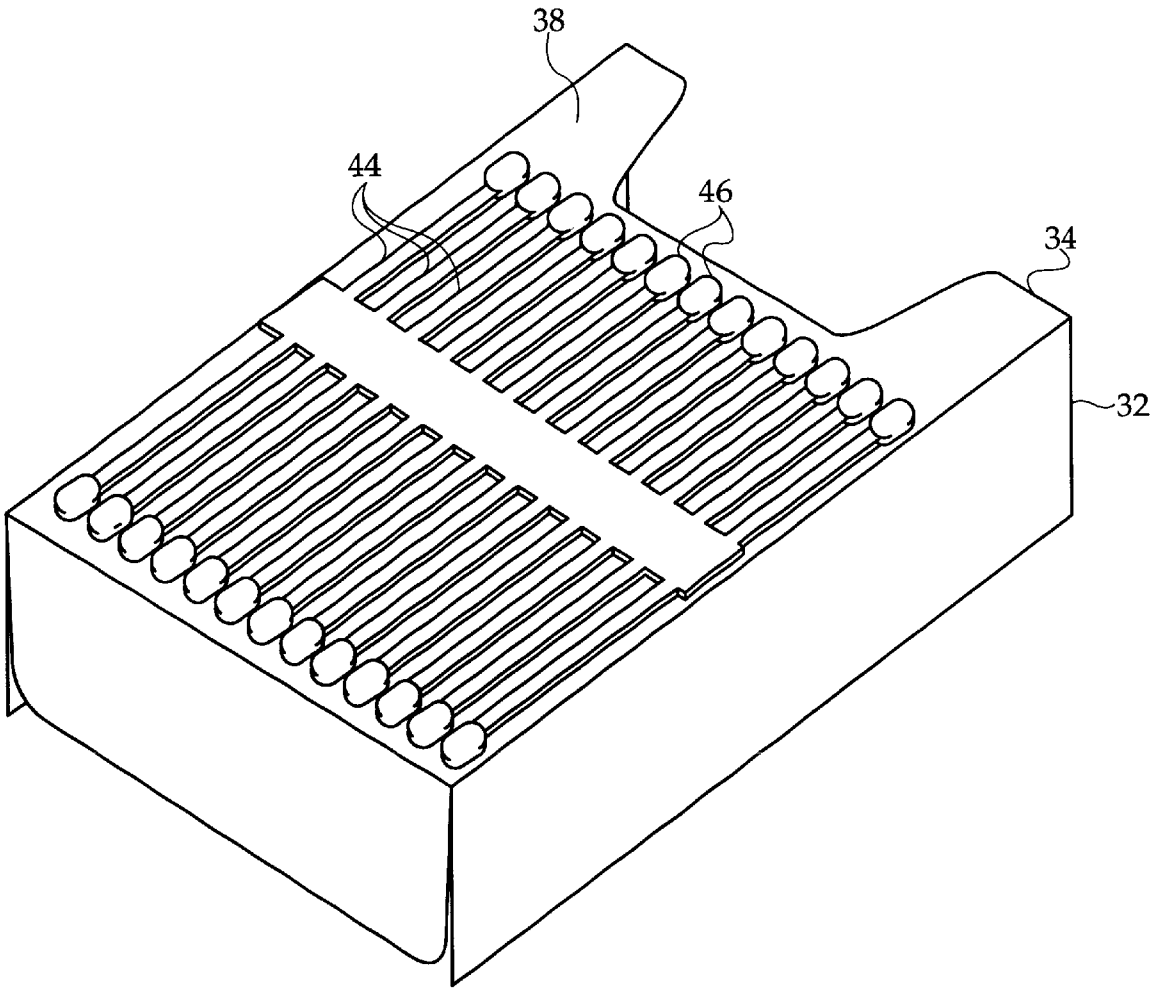
FIG. 5 is a diagrammatic perspective view, illustrating the matches attached to the protective insert.
Figure 6:
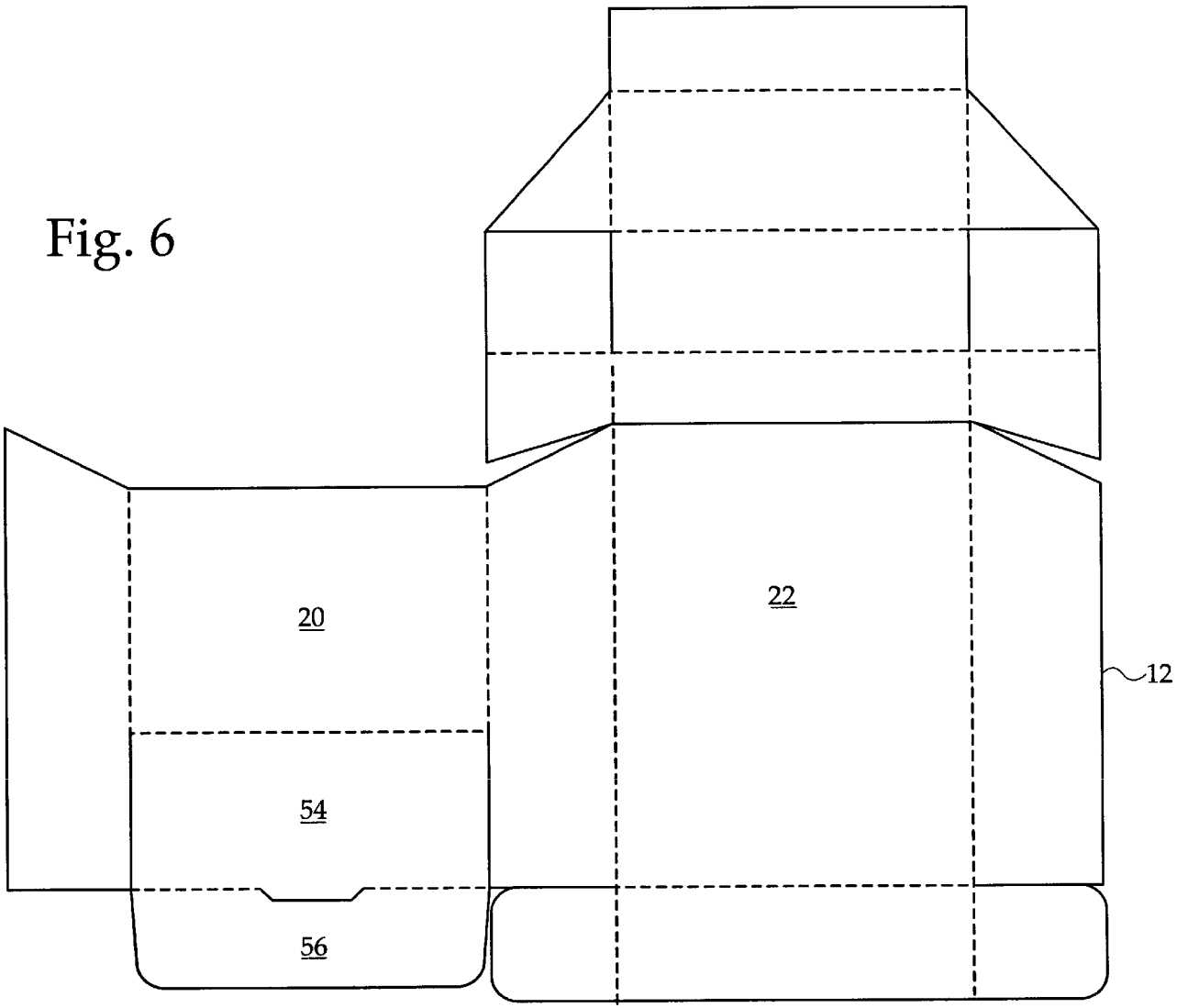
FIG. 6 is a top plan view of the container, unfolded and laid flat.
Figures 7A, 7B, 7C:
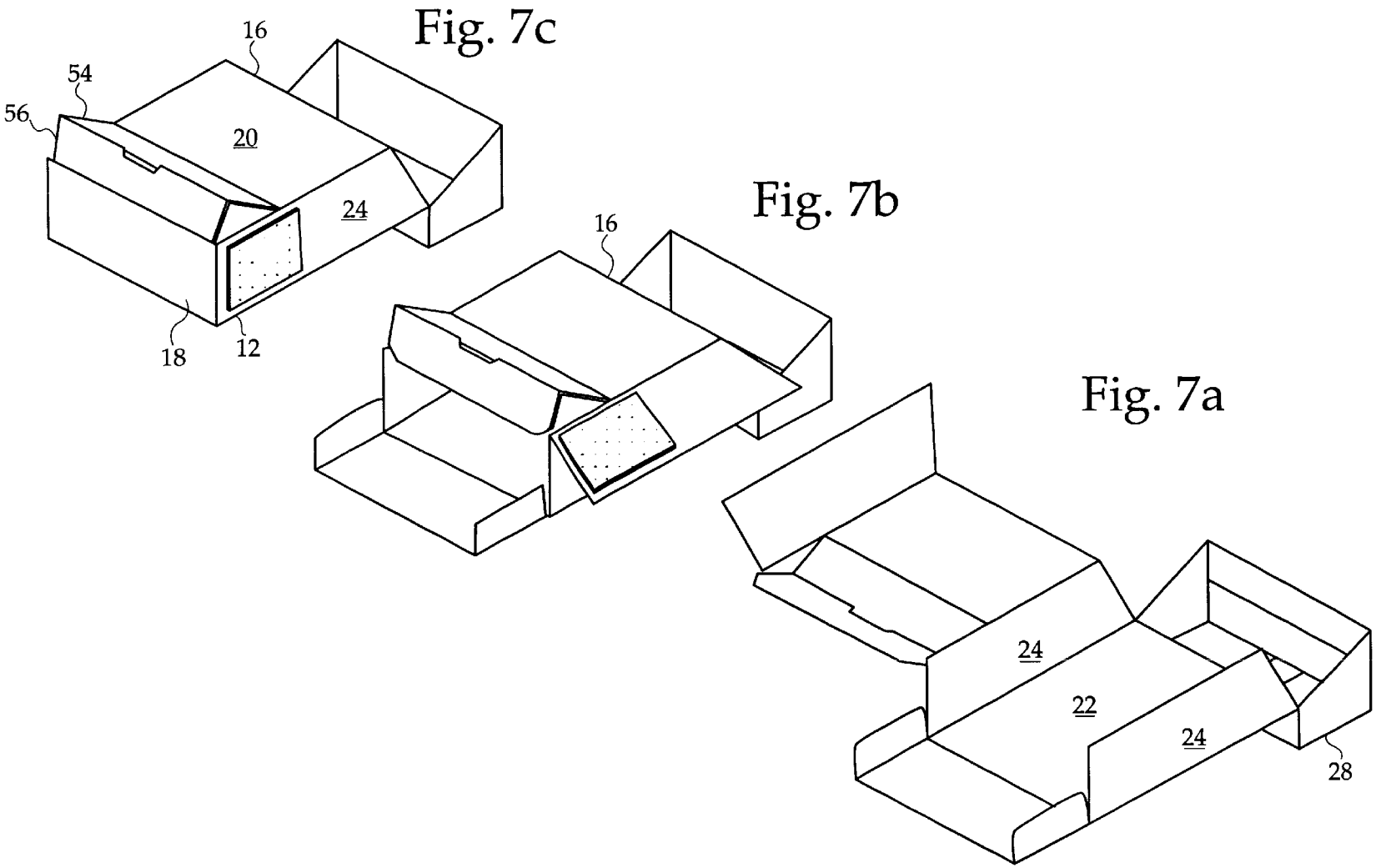
FIGS. 7*a*, 7*b*, and 7*c* illustrate a temporal sequence of assembling the container without the protective insert.
Figure 8:
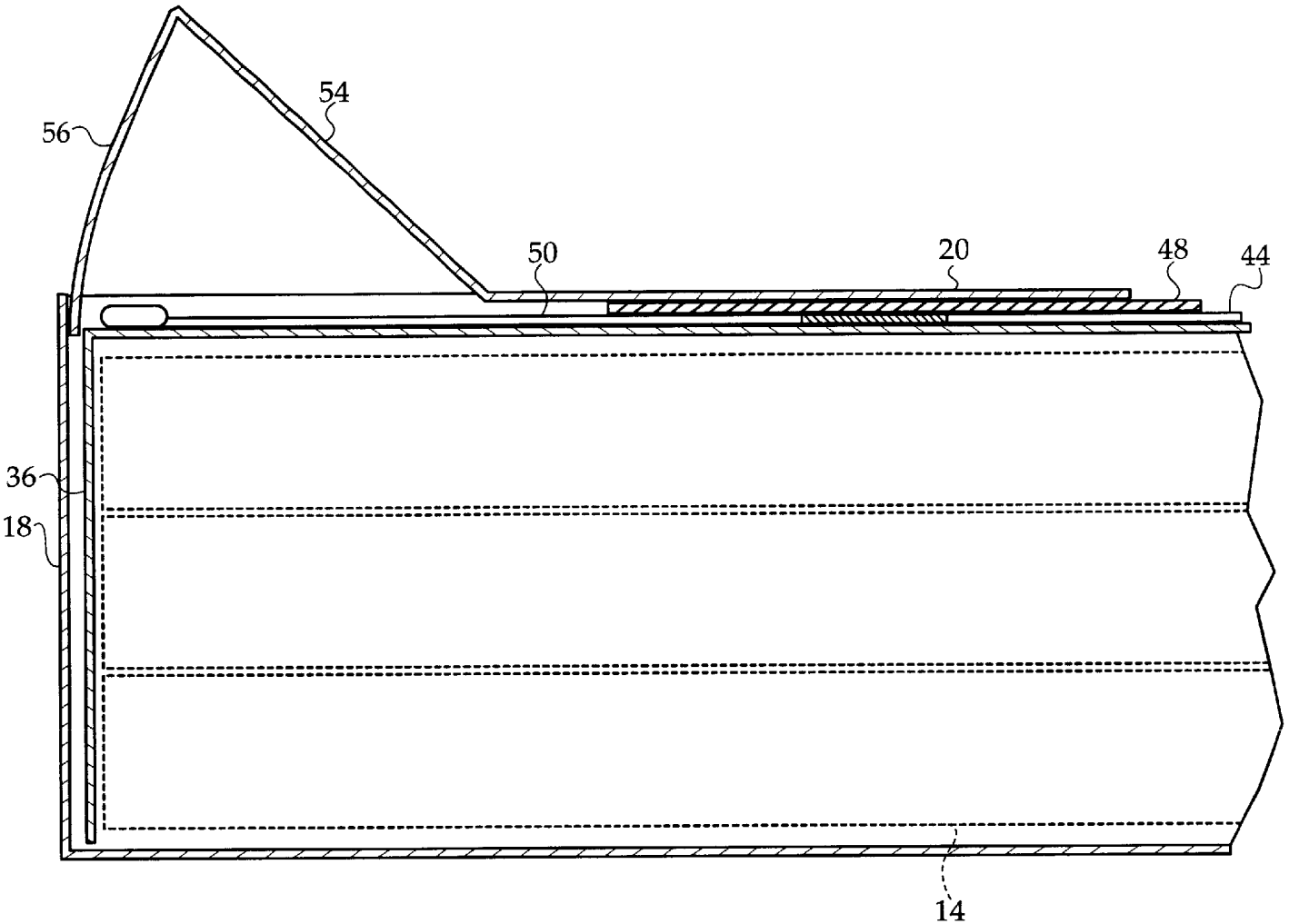
FIG. 8 is a cross sectional view, taken along lines 8—8 in FIG. 1, illustrating the assembled invention, with cigarettes stored therein.

With reference now to the drawings, and in particular, to FIGS. 1 through 3 thereof, the preferred embodiment of the new and improved cigarette package with incorporated matches embodying the principles and concepts of the present invention and generally designated by the reference number 10 will be described.

Specifically, it will be noted in the various Figures that the device relates to a cigarette package with incorporated matches for including a supply of matches for ready use with cigarettes contained therein. In its broadest context, the device consists of a container, a match protector, a protective insert, an upper set of matches, and a lower set of matches. Such components are individually configured and correlated with respect to each other so as to attain the desired objective.

With reference to the various drawing figures, the container 12 has a generally rectangular configuration. The container 12 essentially resembles a standard cigarette package.

The container 12 is dimensioned for containing a quantity of cigarettes 14 therein. The container 12 has an open upper end 16, a closed lower end 18, a front wall 20, a rear wall 22, and opposed side walls 24. The front wall 20 has a lower foldable cover 54 with a flap 56 foldably secured there to for selectively covering the lower matches and upwardly ends below the top end of the match protector 48. A cover member 28 is hingeably attached to the rear wall 22 for selectively closing the open upper end 16 of the container 12. A match striking surface 30 is located on one of the side walls 24 disposed thereon upwardly of the closed lower end 18.

The protective insert 32 is disposed within the container 12. The protective insert 32 has an open upper end 34, a lower end compressible flap 36, a high front wall 38, and opposed side walls 42. The front wall 38 has an arcuate recess 26 extending downwardly thereof facilitating the removal of cigarettes 14. The opposed side walls 42 of the protective insert 32 will protect the cigarettes 14 within the container 12. The front wall 38 and opposed side walls 42 also protect the cigarettes once the matches are struck.

The upper set of matches 44 are removably coupled with the front wall 38 of the protective insert 32 downwardly of the open upper end 34 using a glue strip 35. Each of the upper-set of matches 44 have a lightable tip 46. The upper set of matches 44 have a match protector 48 disposed thereon exposing the lightable tips 46. The lightable tips 46 are covered by the cover member 28 of the container 12 in a closed orientation. The matches 44 can individually be easily removed from the container 12 and lit using the match striking surface 30.

The lower set of matches 50 are removably coupled with the front wall 38 of the protective insert downwardly of the upper set of matches 44. Each of the lower set of matches 50 have a lightable tip 52. The foldable cover 54 disposed on the front wall is positionable over the lower set of matches 50 and the flap 56 selectively covers the lower matches 50. The foldable cover 54 can be opened to allow removal of the lower set of matches 50 in order to light the matches 50 as needed.

Figure 9:
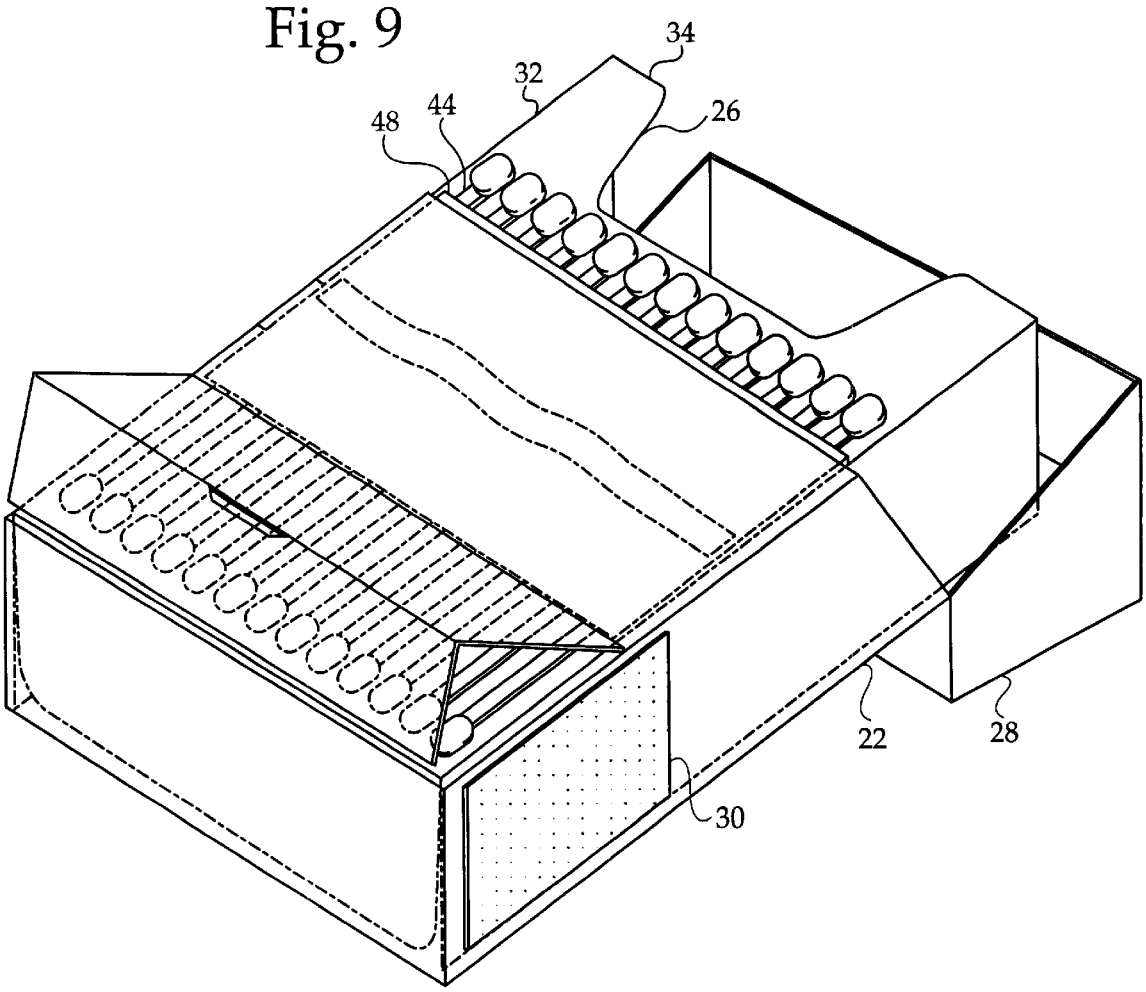
FIG. 9 is a diagrammatic perspective view, illustrating the invention, ready for use.

Referring now to FIG. 9, the cover member 28 is foldably secured to the rear wall 22 for selectively covering the open upper end 34 of the protective insert 32, the arcuate cut out 26 in the protective insert 32, the top set of matches 44, and the match spacer 48.

As to the manner of usage and operation of the present invention, the same should be apparent from the above description.

Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A cigarette package with incorporated matches for including a supply matches for ready use with cigarettes comprising, in combination:

a container having a generally rectangular configuration, the container dimensioned for containing a quantity of cigarettes therein, the container having an open upper end, a closed lower end, a front wall, a rear wall, and opposed side walls, the front wall having a lower foldable cover and flap in communication with the closed lower end, the rear wall having a cover member foldably secured thereto for selectively closing the open end of the container, one of the opposed side walls having a match striking surface disposed thereon upwardly of the closed lower end;

a protective insert disposed within the container, the protective insert having an open upper end, a lower flap, a high front wall, and opposed side walls, the front wall has an arcuate cutout extending downwardly thereof;

an upper set of matches removably coupled with the front wall of the protective insert downwardly of the open upper end, each of the upper set of matches having a lightable tip, the upper set of matches having a match protector disposed thereon exposing the lightable tips, the lightable tips being selectively covered by the cover member of the container in a closed orientation; and a lower set of matches removably coupled with the front wall of the protective insert downwardly of the upper set of matches, each of the lower set of matches having a lightable tip, wherein the lower foldable cover and the flap disposed on the container lower front wall selectively covers the lower set of matches.

2. A cigarette package with incorporated matches for including a supply matches for ready use with cigarettes comprising, in combination:

a container dimensioned for containing a quantity of cigarettes therein, the container having an open upper end, a closed lower end, a front wall, a rear wall, and opposed side walls, the front wall having a lower foldable cover and flap, the rear wall having a cover member foldably secured thereto for selectively covering the open upper end, one of the opposed side walls having a match striking surface disposed thereon upwardly of the closed lower end;

a protective insert located inside of the container;

an upper set of matches removably coupled with the front wall of the protective insert downwardly of the open upper end, each of the upper set of matches having a lightable tip; and a lower set of matches removably coupled with the front wall of the protective insert downwardly of the upper set of matches, each of the lower set of matches having a lightable tip.

3. The cigarette package with incorporated matches as set forth in claim 2, and further including a protective insert disposed within the container.

4. The cigarette package with incorporated matches as set forth in claim 2, wherein the protective insert has an open upper end, a compressable flap lower end, a high front wall, back wall, and opposed side walls.

5. The cigarette package with incorporated matches as set forth in claim 3, wherein the upper set of matches are mounted to the protective insert high front wall, wherein a match protector is mounted between the upper set of matches and the front wall of the container, wherein the upper set of matches have lightable tips, and wherein the lightable tips are covered by the cover member of the container when in a closed orientation.

6. The cigarette package with incorporated matches as set forth in claim 4, wherein the lower set of matches have a foldable cover disposed thereon, the foldable cover having a lower foldable cover positionable between the front wall and the closed lower end of the container in a closed orientation.

7. The cigarette package with incorporated matches as set forth in claim 5, wherein the front wall of the protective insert has an arcuate cutout therein in communication with the open upper end.

* * * * *